US009420905B2

(12) United States Patent
Willingham

(10) Patent No.: US 9,420,905 B2
(45) Date of Patent: Aug. 23, 2016

(54) CUSHION DEVICE

(75) Inventor: William Preston Willingham, Park City, UT (US)

(73) Assignee: Backjoy Orthotics, LLC, Boulder, CO (US)

( * ) Notice: Subject to any disclaimer, the term of this patent is extended or adjusted under 35 U.S.C. 154(b) by 0 days.

(21) Appl. No.: 13/979,132

(22) PCT Filed: Sep. 2, 2011

(86) PCT No.: PCT/US2011/050440

§ 371 (c)(1),
(2), (4) Date: Jul. 10, 2013

(87) PCT Pub. No.: WO2013/032489

PCT Pub. Date: Mar. 7, 2013

(65) Prior Publication Data

US 2013/0291306 A1 Nov. 7, 2013

(51) Int. Cl.
*A47G 9/10* (2006.01)

(52) U.S. Cl.
CPC *A47G 9/10* (2013.01); *A47G 9/109* (2013.01); *A47G 2009/1018* (2013.01)

(58) Field of Classification Search
CPC ..... A47G 9/10; A47G 9/1009; A47G 9/1081; A47G 9/109; A47G 2009/1018; A61G 5/1043; A61G 2005/1045; A61G 2005/1091; A47C 23/007; A47C 27/05; A47C 27/056; A47C 27/144
USPC ..... 5/630, 636, 645, 652, 655.9
See application file for complete search history.

(56) References Cited

U.S. PATENT DOCUMENTS

| | | | | | |
|---|---|---|---|---|---|
| 2,434,641 | A | * | 1/1948 | Burns | 267/117 |
| 2,883,681 | A | * | 4/1959 | Caplan | 5/645 |
| 2,953,195 | A | * | 9/1960 | Turck, Jr. | 267/145 |
| 3,109,182 | A | * | 11/1963 | Doak | 5/636 |
| D229,266 | S | * | 11/1973 | Zacharias | D6/601 |
| 3,787,908 | A | * | 1/1974 | Beck et al. | 5/676 |
| 3,924,283 | A | | 12/1975 | Shave | |
| 4,229,847 | A | * | 10/1980 | Degen | 5/724 |
| 4,429,427 | A | * | 2/1984 | Sklar | 5/654.1 |

(Continued)

FOREIGN PATENT DOCUMENTS

| | | |
|---|---|---|
| JP | 50-051168 | 4/1950 |
| JP | H1156559 A | 3/1999 |

(Continued)

OTHER PUBLICATIONS

International Preliminary Report on Patentability dated Mar. 13, 2014 for International Application No. PCT/US2011/050440 from the International Bureau of WIPO, pp. 1-7, Geneva Switzerland.

(Continued)

*Primary Examiner* — David E Sosnowski
*Assistant Examiner* — Eric Kurilla
(74) *Attorney, Agent, or Firm* — Brooks Acordia IP Law, PC; Michael Zarrabian

(57) ABSTRACT

A cushion device including a first material layer is attached with a first plurality of viscoelastic members. A second material layer is attached with a second plurality of viscoelastic members. A material wall surrounds the first material layer and the second material layer. A first fill material is disposed between the first material layer and the second material layer.

32 Claims, 13 Drawing Sheets

(56) References Cited

U.S. PATENT DOCUMENTS

| | | | | | |
|---|---|---|---|---|---|
| 4,779,297 | A * | 10/1988 | Sturges | 5/630 |
| 5,239,716 | A * | 8/1993 | Fisk | 5/630 |
| 5,687,436 | A * | 11/1997 | Denton | 5/653 |
| 5,778,470 | A * | 7/1998 | Haider | 5/645 |
| 5,953,777 | A * | 9/1999 | Buck | 5/636 |
| 5,970,546 | A * | 10/1999 | Danis | 5/636 |
| 6,018,831 | A * | 2/2000 | Loomos | 5/636 |
| 6,018,832 | A * | 2/2000 | Graebe | 5/654 |
| 6,026,527 | A * | 2/2000 | Pearce | 5/654 |
| 6,159,574 | A * | 12/2000 | Landvik et al. | 428/71 |
| 6,161,238 | A * | 12/2000 | Graebe | 5/648 |
| 6,541,094 | B1 * | 4/2003 | Landvik et al. | 428/71 |
| 6,574,814 | B2 * | 6/2003 | Collard et al. | 5/716 |
| 6,857,151 | B2 * | 2/2005 | Jusiak et al. | 5/655.4 |
| 7,624,465 | B2 * | 12/2009 | Oh | 5/740 |
| 7,735,169 | B2 * | 6/2010 | Wassilefsky | 5/636 |
| 8,328,279 | B2 * | 12/2012 | Brncick et al. | 297/228.11 |
| 8,613,120 | B2 * | 12/2013 | Hawkins | 5/740 |
| 8,672,411 | B2 * | 3/2014 | Gomes et al. | 297/452.46 |
| 8,915,339 | B2 * | 12/2014 | Kanous et al. | 188/377 |
| 2005/0081571 | A1 * | 4/2005 | Bhatnagar et al. | 66/202 |
| 2005/0084667 | A1 * | 4/2005 | Landvik et al. | 428/316.6 |
| 2005/0108822 | A1 * | 5/2005 | Wu | 5/630 |
| 2006/0277684 | A1 * | 12/2006 | Wassilefky | 5/636 |
| 2006/0277685 | A1 * | 12/2006 | Foley et al. | 5/653 |
| 2006/0288490 | A1 * | 12/2006 | Mikkelsen et al. | 5/740 |
| 2007/0044239 | A1 * | 3/2007 | Leifermann et al. | 5/636 |
| 2007/0044244 | A1 * | 3/2007 | Ahn et al. | 5/721 |
| 2007/0245493 | A1 * | 10/2007 | Leifermann et al. | 5/636 |
| 2008/0060139 | A1 * | 3/2008 | Mossbeck | 5/724 |
| 2008/0155753 | A1 * | 7/2008 | Cretsinger | 5/640 |
| 2008/0307581 | A1 * | 12/2008 | Wassilefky | 5/636 |
| 2009/0100606 | A1 * | 4/2009 | An | 5/716 |
| 2009/0133195 | A1 * | 5/2009 | Elzenbeck | 5/718 |
| 2009/0276960 | A1 * | 11/2009 | Chou | 5/640 |
| 2011/0131729 | A1 * | 6/2011 | Shiao | 5/640 |
| 2011/0252567 | A1 * | 10/2011 | Yu | 5/640 |
| 2011/0256369 | A1 * | 10/2011 | Switzer et al. | 428/215 |

FOREIGN PATENT DOCUMENTS

| | | | | |
|---|---|---|---|---|
| JP | 2000508211 | A | 7/2000 | |
| WO | WO-2010/075294 | A1 | 7/2010 | |
| WO | WO 2010075231 | A1 * | 7/2010 | A47C 27/00 |

OTHER PUBLICATIONS

Extended European Search Report for European Patent Application No. EP 11 87 1810, mailed Apr. 22, 2015.

First Office action for Japanese Patent Application No. 2014-528344, mailed May 26, 2015.

Final Decision for Rejection for Japanese Patent Application No. 2014-528344, mailed Jan. 19, 2016.

* cited by examiner

CUSHION DEVICE

This application is the U.S. National Phase Patent Application under 35 U.S.C. §371 of International Application Number PCT/US2011/050440, filed on Sep. 2, 2011, the disclosure of which is incorporated herein by reference.

FIELD OF THE INVENTION

The present invention relates in general to cushions and in particular to an active multi-positional support cushion.

BACKGROUND OF THE INVENTION

Cushions used for resting or sleeping are used in pillows. Most cushions include a fill portion for supporting a user's head while sleeping, or other parts of the anatomy as desired. Some pillows use memory foam to support a user's head while resting on the pillow. When the user removes their head from the pillow, the pillow returns to the original shape. These pillows typically react to the weight placed upon it and only passively support the weight based on the thickness or density of the memory foam.

BRIEF SUMMARY OF THE INVENTION

The present invention provides a cushion device. In one embodiment, the present invention includes a first material layer attached with a first plurality of viscoelastic members. A second material layer is attached with a second plurality of viscoelastic members. A material wall surrounds the first material layer and the second material layer. A first fill material is disposed between the first material layer and the second material layer.

In another embodiment the present invention provides a cushion device including a first material layer having varying thickness. The first material layer comprising at least one viscoelastic material. A second material layer is included. A material wall surrounds the first material layer and the second material layer. A first fill material is disposed between the first material layer and the second material layer.

In one embodiment the present invention provides a support pillow including a first viscoelastic material layer is coupled with an opposing first pair of viscoelastic members. A second viscoelastic material layer is coupled with an opposing second pair of viscoelastic members. A material wall surrounds the first material layer and the second material layer. The material wall comprising synthetic fiber material made from a polymer containing polyurethane. A first fill material is disposed between the first material layer and the second material layer.

Other aspects and advantages of the present invention will become apparent from the following detailed description, which, when taken in conjunction with the drawings, illustrate by way of example the principles of the invention.

DETAILED DESCRIPTION OF THE INVENTION

The present invention provides a cushion device for improving posture and support. One embodiment of the invention comprises a cushion device. In one embodiment, the present invention includes a first material layer attached with a first plurality of viscoelastic members. A second material layer is attached with a second plurality of viscoelastic members. A material wall surrounds the first material layer and the second material layer. A first fill material is disposed between the first material layer and the second material layer.

Figure 1:
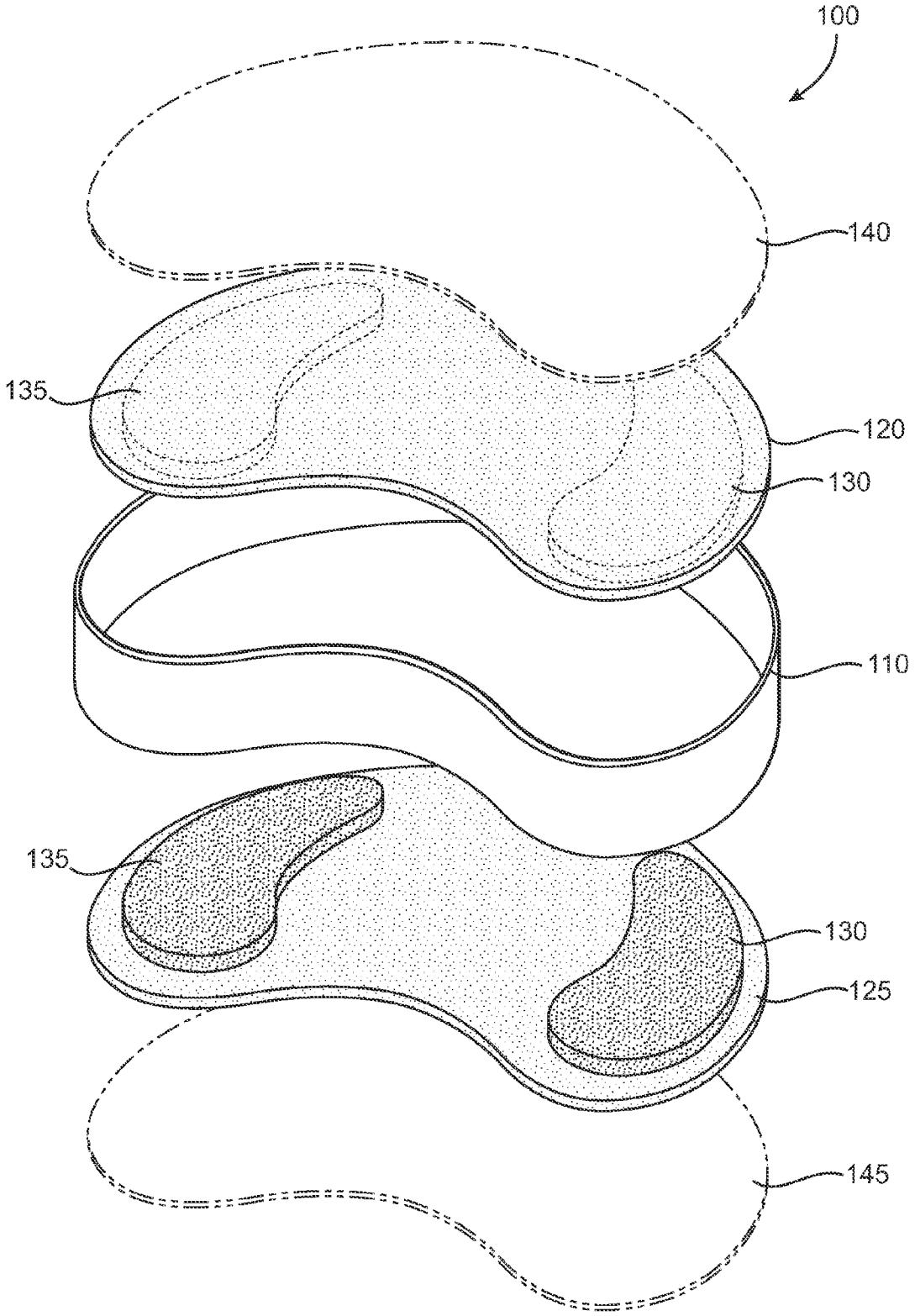
FIG. 1 shows an exploded view of an active support cushion, according to an embodiment of the invention.

FIG. 1 shows an exploded view of an active support cushion device 100, according to an embodiment of the invention. In one example, the active support cushion device 100 includes a first layer 120, a second layer 125 and a material wall 110 that surrounds the first material layer 120 and the second material layer 125. In one example, the first material layer 120 and the second material layer 125 comprise a viscoelastic material, such as memory foam, polyurethane foam, or other similar material. In one embodiment of the invention, the first material layer 120 and the second material layer 125 each include viscoelastic members 130 and 135. In one example, the viscoelastic material comprises memory foam or other similar material.

In one embodiment of the invention, the first material layer 120 includes the viscoelastic members 130 and 135 on a bottom portion of the first material layer 120, and the second material layer 125 includes the viscoelastic members 130 and 135 on a top portion of the second material layer 120. In one example, the first material layer 120 and the second material layer 125 each have a curved shape. In another example, the viscoelastic members 130 and 135 may have a curved or tear-drop shape that mirrors one another.

In one embodiment of the invention, the viscoelastic members 130 and 135 are displaced a predetermined distance from edges of the material wall 110. In one example, the viscoelastic members 130 and 135 are displaced a distance ranging from 10 mm to 20 mm from the edges of the material wall 110. In one example, placing the viscoelastic members 130 and 135 a predetermined distance from the material wall, for example, 20 mm to 40 mm provides for time and displacement controlled stretching. In one embodiment of the invention, viscoelastic members 130 and 135 are separated by a distance from one another ranging from 20 cm to 30 cm.

In one embodiment of the invention, the viscoelastic members 130 and 135 may have a thickness equal or greater than the thickness of the first material layer 120 and the second material layer 125. In one example, the thickness of the first material layer 120 and the second material layer 125 ranges from 8 mm to 15 mm, and the thickness of the viscoelastic members 130 and 135 range from 8 mm to 15 mm. The dimensions of each viscoelastic member 130 and 135 may range from a length of 30 cm to 40 cm and a width of 12 cm to 16 cm.

In one embodiment of the invention, the viscoelastic members 130 and 135 are a pair of viscoelastic members that are disposed on opposite ends of the active support cushion device 100. It should be noted that while a pair of viscoelastic members 130 and 135 are shown, other examples may include more than two viscoelastic members 130 and 135. In one example, each viscoelastic member 130 and 135 may comprise multiple individual viscoelastic members.

In one embodiment of the invention, the viscoelastic members 130 and 135 are attached to the first material member 120 and the second material member 125 via adhesive, heat welding, molding, etc. In one embodiment of the invention, the viscoelastic members 130 and 135 and the first material layer and the second material layer are formed as a single unit. In one example, the first material layer and the second material layer have a varying thickness that ranges from 8 mm to 20 mm.

In one embodiment of the invention, the material wall 110 comprises synthetic fiber material made from a polymer containing polyurethane, such as SPANDEX®, cotton-lycra blends, polypropylene-SPANDEX® blends, or other similar materials. In other embodiments of the invention, the material wall is non-elastic. In one example, the material wall 110 interacts with the first material layer 120 including viscoelastic members 130 and 135 and the second material layer 125 including viscoelastic members 130 and 135 to actively support a user's anatomy (e.g., a head) when placed on the active support cushion device 100.

In one embodiment of the invention, the active support cushion device 100 may include a third material layer 140 and a fourth material layer 145. In one example, the third material layer 140 may comprise desired material for covering the first material layer 120, and the fourth material layer 145 may comprise desired material for covering the second material layer 125. In one example, the desired material may include cotton, silk, cheese cloth, synthetic materials, etc.

Figure 2A:
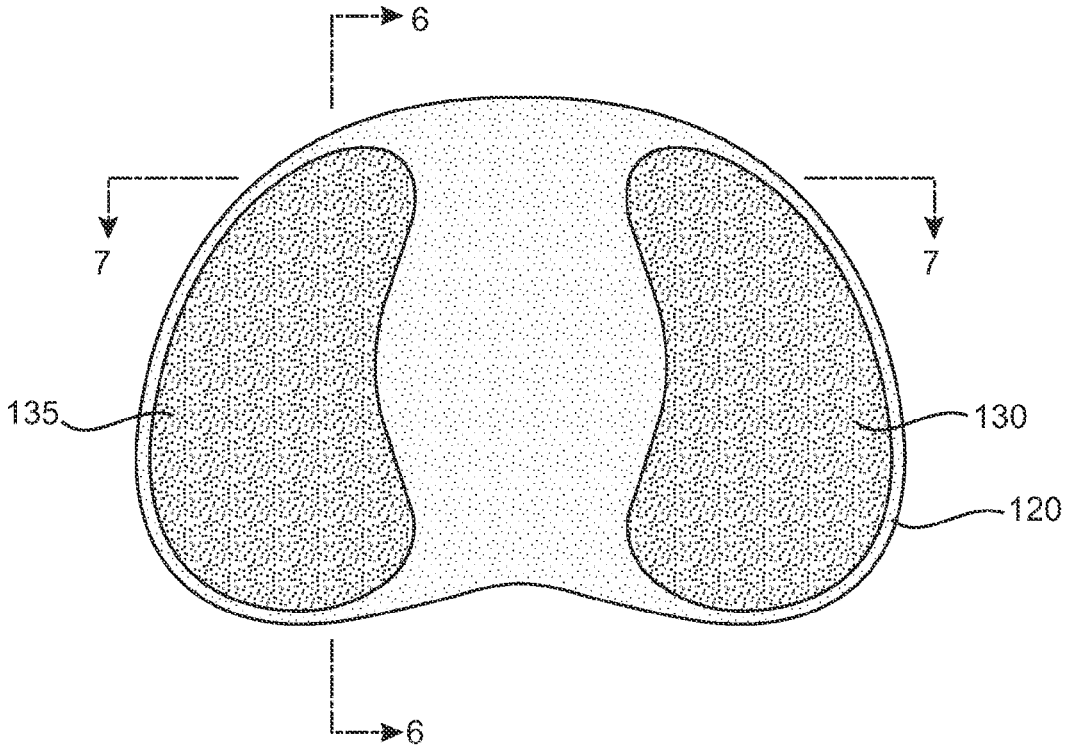
FIG. 2A shows a top view of a material layer of the cushion apparatus shown in FIG. 1, according to an embodiment of the invention.
Figure 2B:
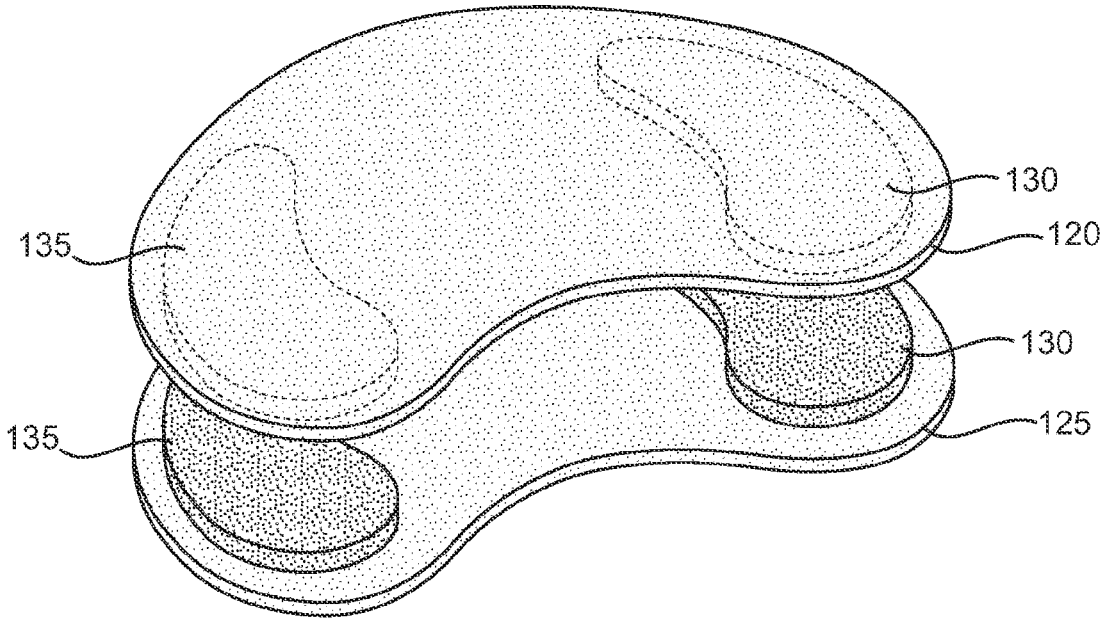
FIG. 2B shows an exploded view of two layers of the cushion apparatus shown in FIG. 1, according to an embodiment of the invention.

FIG. 2A shows a top view of the first material layer 120 including viscoelastic members 130 and 135 of the active support cushion device 100, according to an embodiment of the invention having cross-sectional lines 6-6 and 7-7. FIG. 2B shows an exploded view of the first material layer 120 including viscoelastic members 130 and 135 and the second material layer 125 including viscoelastic members 130 and 135, according to an embodiment of the invention. In one example, the first material layer 120 and the second material layer 125 mirror one another.

Figure 3:
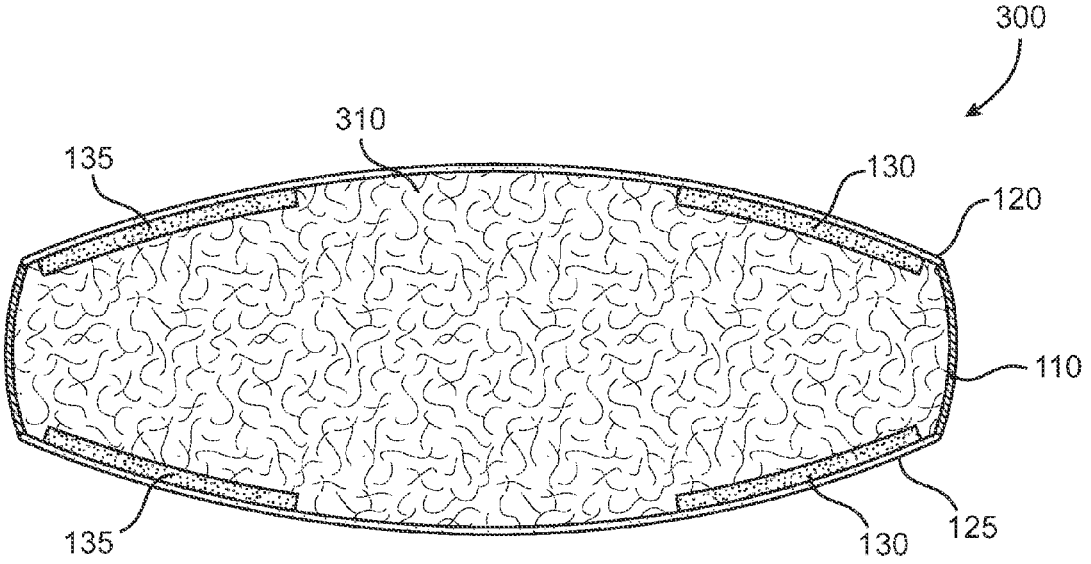
FIG. 3 shows a front cross sectional view of a cushion device, according to an embodiment of the invention.

FIG. 3 shows a front cross sectional view of the active support cushion device 300 shown through line 7-7 (FIG. 2A), according to an embodiment of the invention. In one example, the active support cushion device 300 includes a fill material 310. In one example, the fill material 310 may comprise feathers, synthetic feathers, cotton, wool, foam, latex, polyester, ethylene vinyl acetate (EVA) foam, cellulose, organic materials, husks/hulls (e.g., buckwheat, bean sprout, millet, kapok, etc.), polyoleen, inorganic materials, etc. In one embodiment of the invention, the fill material 310 is surrounded with a protection material or disposed in a protective bag. In one example, the protective covering or bag prevents a portion of the fill material 310, such as feather quills or other feather portions, from protruding through the first material layer 120 and the second material layer 125.

Figure 4:
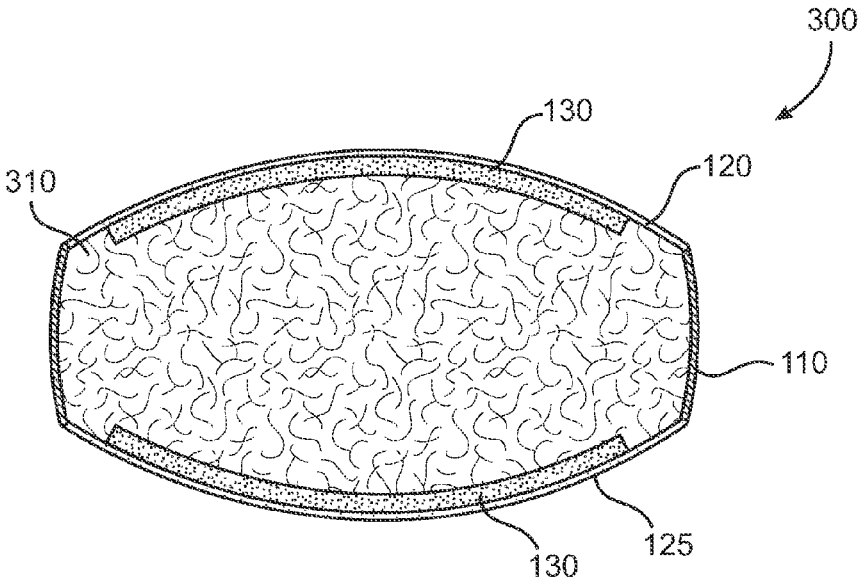
FIG. 4 shows a side cross-sectional view of a cushion device, according to an embodiment of the invention.

In one example, the fill material 310 fills the volume between the first material layer 120 with viscoelastic members 130 and 135, the second material layer 125 with viscoelastic members 130 and 135, and the elastic wall 110. FIG. 4 shows a side cross sectional view of the active support cushion device 300 shown through line 6-6 (FIG. 2A), according to an embodiment of the invention.

Because the first material layer 120 includes the viscoelastic members 130 and 135, the upper surface of the first material layer has regions of varying flexibility or stretching characteristics. In one example, the elastic wall 110 reacts to an applied force (e.g., from weight of a user's head) due to the elastic characteristics surrounding the first material layer 120 and the second material layer 125 of the active support cushion device 300. In one embodiment of the invention, the first material layer 120 and viscoelastic members 130 and 135 are laminated foam-to-foam to restrict the stretching of the first material layer 120 and add a "floating" effect on the interior fill. The shape of viscoelastic members 130 and 135 directly effect how and where the elastic configuration is effected. This also has an effect on the degree of tension that pulls the elastic wall 110.

In one embodiment of the invention, the amount of fill material 310 used controls the depth that a person's head sinks into the center of the support cushion device 300 and comes to rest. In one example, a first volume of fill material 310 controls the depth that a person's head sinks into the center of the support cushion device 310 to 5 to 6 cm. In other examples, a volume of fill material 310 is used to control the depth a person's head sinks into the center of the support cushion device 300 to 3 to 4 cm, or 2 to 3 cm.

Figure 5:
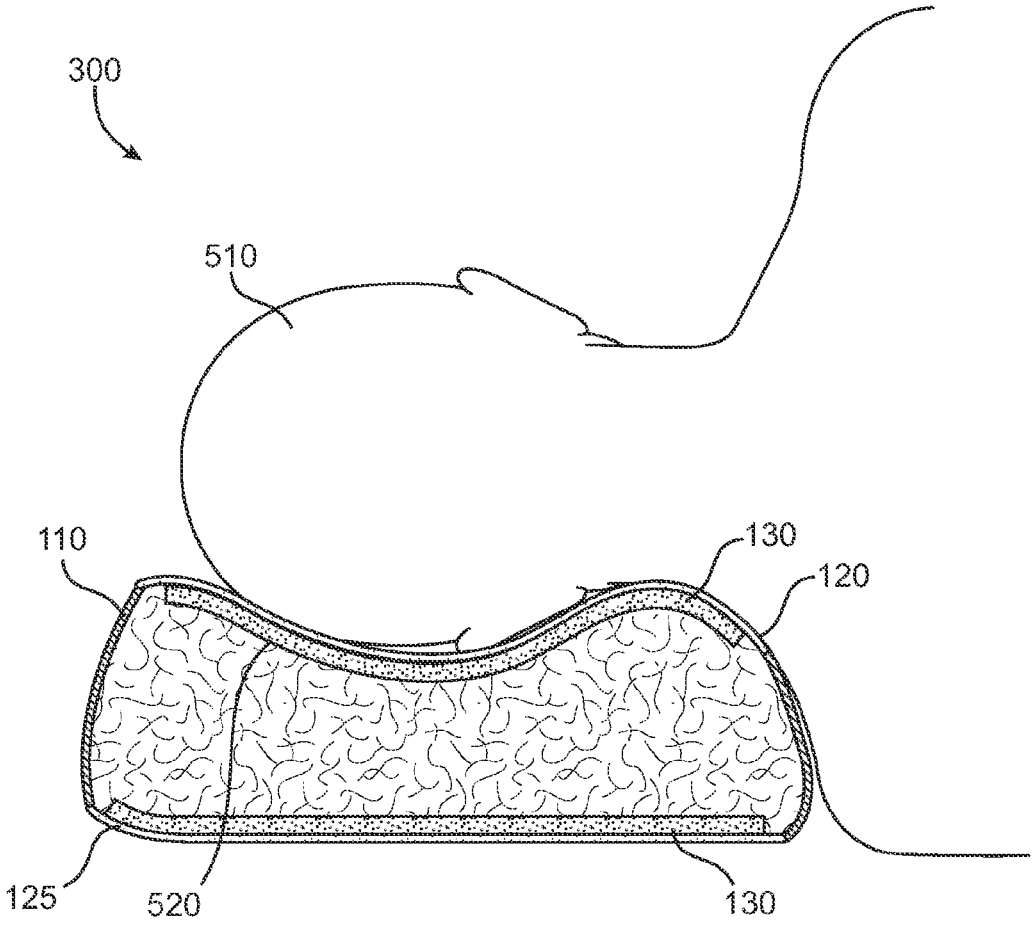
FIG. 5 shows a side cross-sectional view of a cushion device showed with a head in a side position on the cushion device, according to an embodiment of the invention.

FIG. 5 shows a side cross-sectional view along line 6-6 (FIG. 2A) of the active support cushion device 300 showed with a head 510 lying in a side position on the active support cushion device 300, according to an embodiment of the invention. The dashed line 520 represents the stretched position of the first material layer 120 after the head 510 is placed on top of the active support cushion device 300.

In one example, the weight of the head 510 stretches the first material layer 120 toward the center of the active support cushion device 300 and the viscoelastic members 130 and 135 control the stretching while the active wall 110 acts bi-directionally to add support by pushing and pulling back on opposite sides as it attempts to return to the original state. A portion of the second material layer 125 and viscoelastic members 130 and 135 is stretched upward due to the weight of the head 510 and opposing forces of the first material layer 120, the second material layer 125, the viscoelastic members 130 and 135, and the elastic wall 110 attempting to return to their unstretched state. The active support cushion device 300 including the viscoelastic members 130 and 135 in conjunction with the active wall 110 dynamically controls the speed of the resistance to the weight of the head 510. The structure of the active wall 110 acts as the springs and frame of a trampoline with the first material layer 120 and second material layer 125 being the cradling surface, which work in concert not only to one another but to the fill material 310 they trap inside between them. The fill material 310 compresses and moves away from the opposing forces of the head 510 filling and expanding against the memory retentive materials. This creates a balloon like material filling into spaces such as the neck and jaw area of a user.

Each material of the elements of the active cushion device 300 has a different bi-directional stretch and memory speed comes into play as it reacts to the size, shape and position of the head 510. The speed and resistance against the forces and speed and retuning memory affect the feel of the user's movements and the anatomical positioning once the muscles are relaxed and gravity is in control. The active cushion device 300 provides a user with a sensation like they are floating in a liquid-like state without any wave action, but with the suspended cradled support floating the head 510 in any sleeping position. The materials displaced by the head 510 that are ballooning and squeezing into unfilled areas provide a uniform support that conforms to the irregular shapes of the head 510, neck and jaw. The opposing forces of the active wall 110 and the viscoelastic foam effected by the heat and weight of the head 510 results in a predictable speed of resistance and return, as well as the depth of the resting place the position of the head 510 resides.

Figure 6:
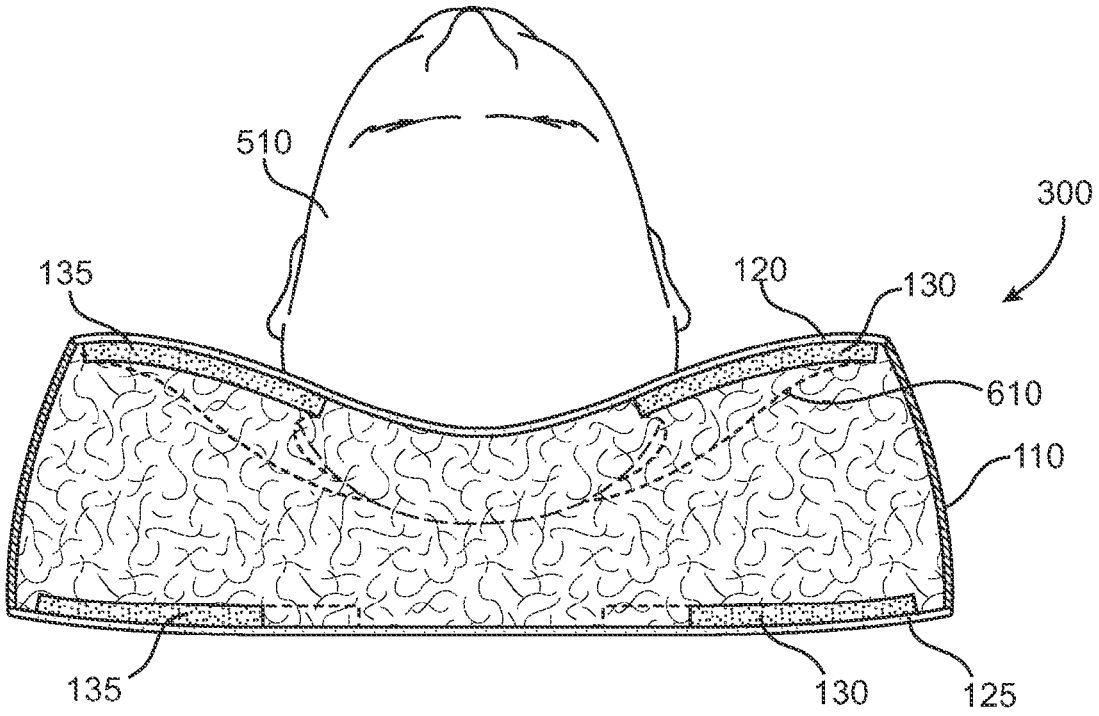
FIG. 6 shows a rear cross-sectional view of a cushion device showed with a head shown in a supine position on the cushion device, according to an embodiment of the invention.

FIG. 6 shows a rear cross-sectional view along line 7-7 (FIG. 2A) of the active support cushion device 300 showed with a head 510 lying in a supine position on the active support cushion device 300, according to an embodiment of the invention. The dashed line 610 represents the depth and outline of the head 510 in the middle portion of the active support cushion device 300. The dashed line above the dashed line 610 represents the stretched position of the first material layer 120 after the head 510 is placed on top of the active support cushion device 300. In one example, the weight of the head 510 stretches the first material layer 120 toward the center of the active support cushion device 300 and the viscoelastic members 130 and 135 control the stretching while the active wall 110 acts bi-directionally to add support by pushing and pulling back on opposite sides as it attempts to return to the original state. The dashed lines next to the viscoelastic members 130 and 135 represent the stretched position of the viscoelastic members 130 and 135 when the head 510 is placed on the active support cushion device 300. Because the first material layer 120 and the viscoelastic members 130 and 135 of the active support cushion device 300 do not form a thick block of viscoelastic foam, the materials can only stretch under the force of the weight and temperature of the head 510. This causes the first material layer 120 to stretch and bend down into the underlying fill 310 material unrestricted by the bidirectional fabrics of the active wall 110 surrounding the viscoelastic foam sheeting of the first material layer, the second material layer and the viscoelastic members 130 and 135.

The opposing forces of the active wall 110 and the first material layer 120, second material layer and respective viscoelastic members 130 and 135 effected by the heat and weight of the head 510 result in a predictable speed of resistance and return as well as the depth of the resting place that the position of the head 510 resides. With the bi-directional active wall 110 along with the bi-directional memory retentive viscoelastic foam of the first material layer 120, second material layer 125 and respective viscoelastic members 130 and 135 reacting to the shape, size, weight and temperature of the head 510, the opposing forces of the memory retentive viscoelastic foam verses the anatomical position have a direct interplay with the distance the center of the head 510 has to the circumference of the active wall 110. This acts much like the effect one achieves when bouncing in the center of a trampoline or nearer the edge of the springs at the trampoline's circumference.

Figure 7:
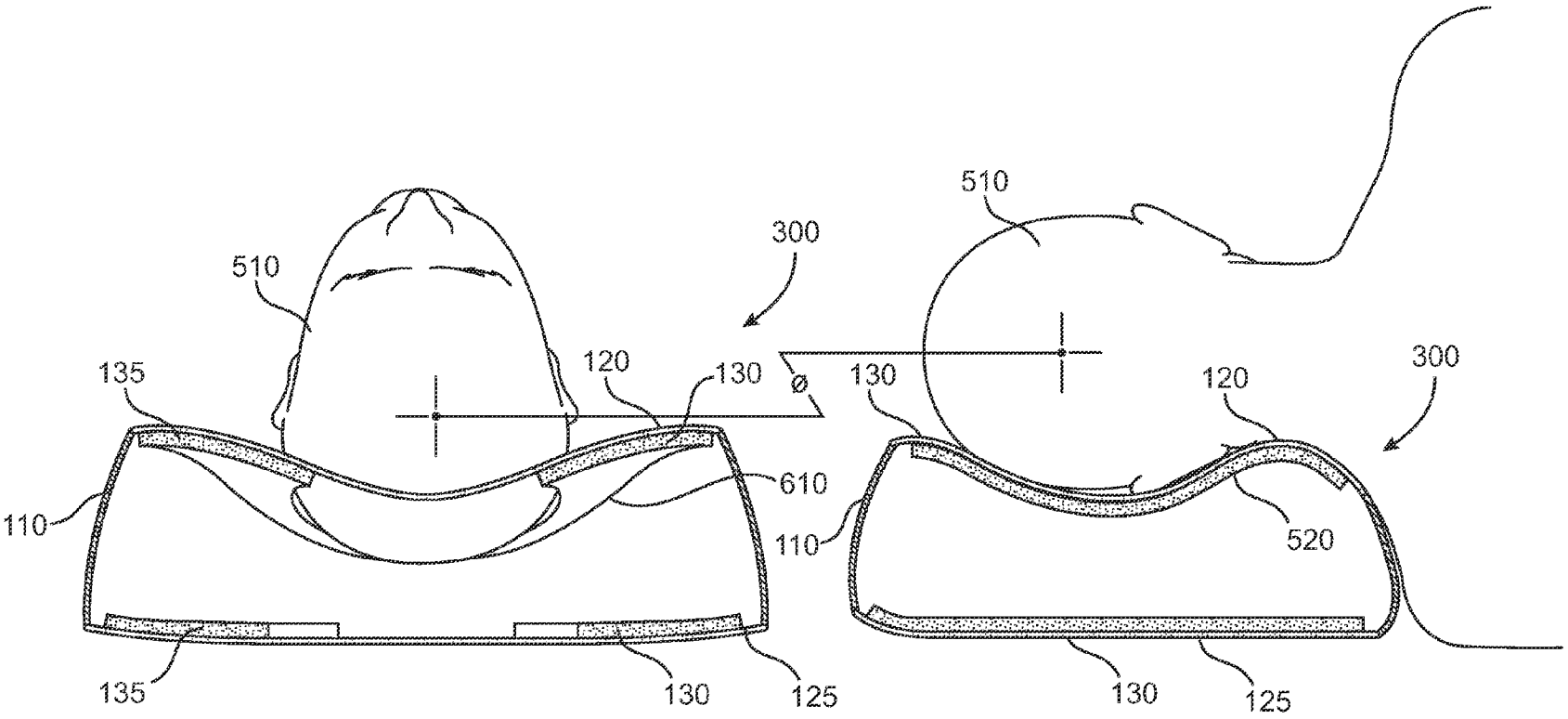
FIG. 7 shows a comparison of the head positions on the cushion device as shown in FIGS. 5-6, according to an embodiment of the invention.

FIG. 7 shows a comparison of the head 510 positions on the active support cushion device 300 in a supine position (FIG. 6) and a side position (FIG. 5), according to an embodiment of the invention. When the head 510 is in this supine position (FIG. 6) the radius of the cranium makes the foot print on the cushion device 300 smaller than if the cranium was on its side. To achieve a preferred cervical curve the cranium needs to come to a deeper resting position when lying on ones back. In the center position between viscoelastic members 130 and 135 as illustrated FIG. 6, the cranium can maximize the center of the "trampoline" to stretch to its furthest point. FIG. 5 shows the result of a person that has rolled into a side sleeping position. This anatomical movement roles the cranium onto the side of the face and away from the center of the cushion device 300. Once a rolling of the head 510 occurs, this places the head 510 above the viscoelastic members 130 or 135, which restricts the stretching of the first material layer 120. This position is also closer to the active wall 110. In combination with the reduced ability to stretch and the additional floating effect of the viscoelastic members 130 or 135 layers of the cushion device 300 along with the greater pull of the active wall 110 causes the head 510 to come to rest at a higher depth than in the area between the viscoelastic members 130 or 135 layers of the cushion device 300.

Figure 8A:
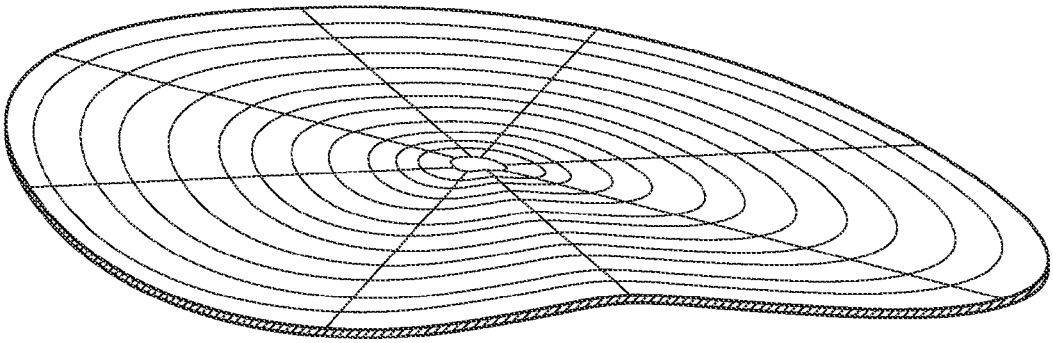
FIG. 8A shows a top view of an upper portion of a cushion device at a resting state, according to an embodiment of the invention.
Figure 8B:
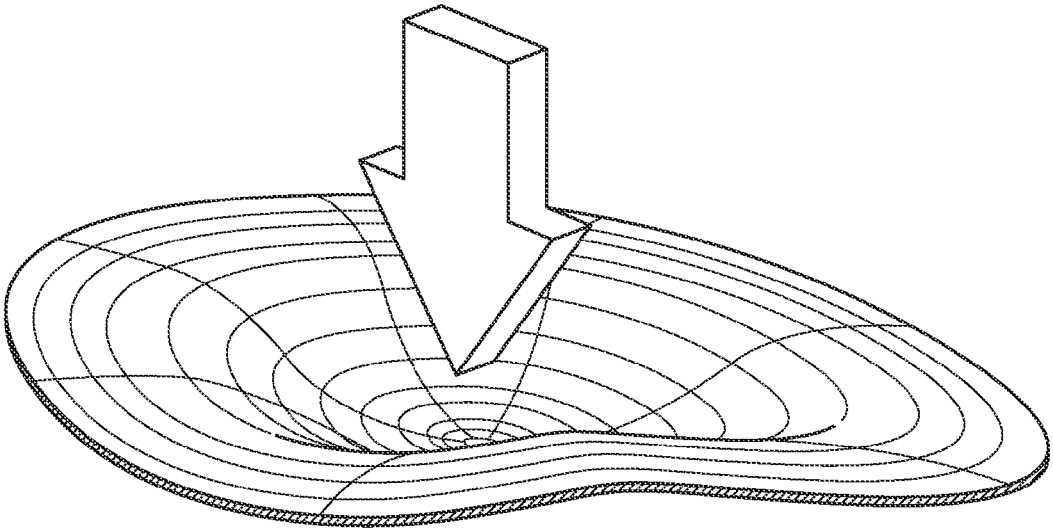
FIG. 8B shows a top view of an upper portion of the cushion device of FIG. 8A with a force applied in the direction of the arrow, according to an embodiment of the invention.

FIG. 8A shows a top view of an upper portion of an active support cushion device 100/300 at a resting state, according to an embodiment of the invention. FIG. 8B shows a top view of the upper portion of the active support cushion device 100/300 of FIG. 8A shown with an applied force in the direction of the arrow, according to an embodiment of the invention. FIG. 8A illustrates the difference the sheet of viscoelastic foam including the first material layer 120 and viscoelastic members 130 and 135 stretches at its center and edges. FIG. 8A illustrates the assumption that the circumference is affixed to the active wall 110 bi-directional fabric as a means of applying an opposing force at the circumference of the viscoelastic foam sheeting of the first material layer 120 and viscoelastic members 130 and 135. The circles are further apart the farther the distance is from the outside edges of the sheet where it attaches to the active wall 110 once a force is applied to the viscoelastic foam sheeting of the first material layer 120 and viscoelastic members 130 and 135. This trampoline effect is shown by FIG. 8A, FIG. 8B, and FIGS. 9A and 9B.

Figure 9A:
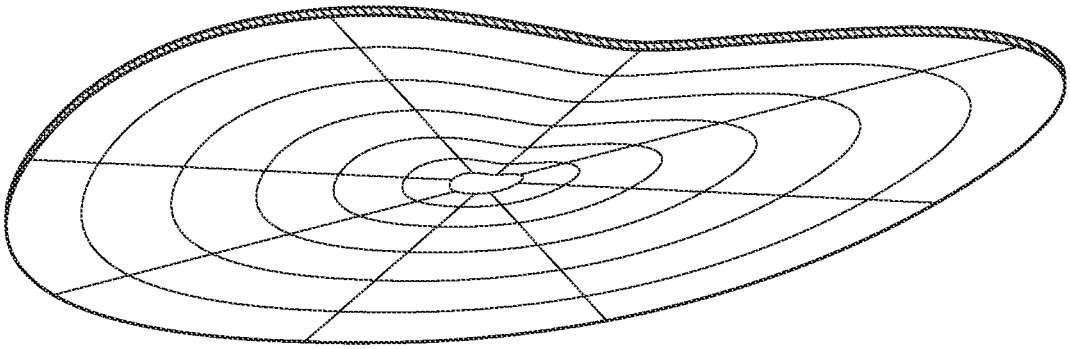
FIG. 9A shows a bottom view of an upper portion of a cushion device at a resting state, according to an embodiment of the invention.
Figure 9B:
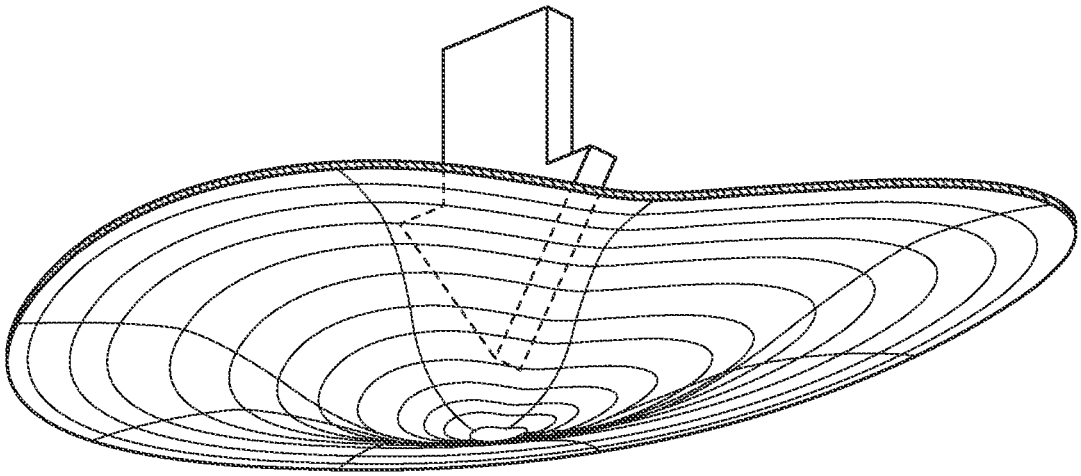
FIG. 9B shows a bottom view of an upper portion of a cushion device of FIG. 9A with a force applied in the direction of the arrow, according to an embodiment of the invention.

FIG. 9A shows a bottom view of the upper portion of an active support cushion device 100/300 at a resting state, according to an embodiment of the invention. FIG. 9B shows a bottom view of the upper portion of the active support cushion device 100/300 of FIG. 9A shown with an applied force in the direction of the arrow 820, according to an embodiment of the invention.

Figure 10:
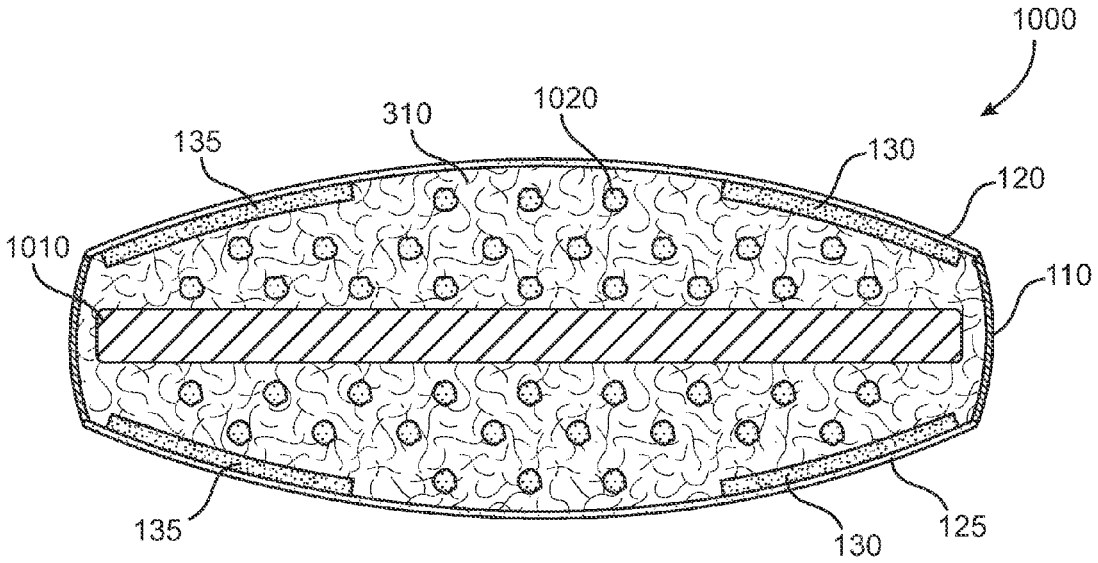
FIG. 10 shows a front cross sectional view of a cushion device including a firming fill element, according to an embodiment of the invention.

FIG. 10 shows a front cross sectional view along line 7-7 of an active support cushion device 1000 including a firming fill element 1010, according to an embodiment of the invention. In one example, the firming fill element 1010 may comprise a fiberfill/polyfill or similar material. In one embodiment of the invention, the firming fill element is centered in the fill 310 so as to be equidistant from the first material layer 120 and the second material layer 125. In one example, the firming fill 1010 may comprise one or more integral members that span the length and width of the active support cushion device 1000. In another example, the firming fill material may be dispersed unequally within the fill 310. In one example, a suspension fill material 1020 is dispersed with the fill 310 for reducing or preventing the fill 310 materials from clumping together. In one example, the suspension fill material 1020 may include fiber material, wool material, foam material, etc. In one example, the suspension fill material 1020 separates the fill 310 materials or elements from sticking together, which allows the fill 310 material to remain fluffed. Other examples of fill 310 include natural matting or batting material, a bladder that fills with an air, liquid or gel, etc.

In one example, the suspension fill material 1020 is used in between the fill 310 to suspend and create a "loft" effect. The suspension fill material 1020 creates an artificial feather and down relationship in combination that acts as a memory retentive fill material that has a mixing of a material that keeps the memory retentive balls of the suspension fill material 1020 from congregating together and can control the loft of the overall fill of the cushion device 1000. The combined fill 310 and suspension fill material 1020 creates a same relationship that natural feathers and down feathers have in combination, where the feather acts as a separating layer between down feathers. The down gives a loft to the combination while the feathers give a separating suspending agent to the mixture. In one example, the suspension fill material 1020 comprises a microfiber synthetic ball combined with shredded plastic sheeting that may be mixed in different ratios to control the speed of compression and speed of return of the fill material 310. The combination has two aspects: 1) to control the durometer of the fill 310; and 2) to keep the balls of memory retentive material from congregating together and filing the interior space with non-memory retentive material in combinations. This mixture of small balls of synthetic microfiber poly fill separated by small shredded very thin plastic sheeting can control the overall thickness and density of the cushion device 1000. The combination of the fill material 310 being incased in the bi-directional balloon like enclosure of the cushion device 1000 will be displaced by the forces of a body part and push against the inside surfaces of bi-directional fabrics and viscoelastic foam to push those surfaces outwardly for filling in and around the irregular shapes of the human anatomy.

Figure 11A:
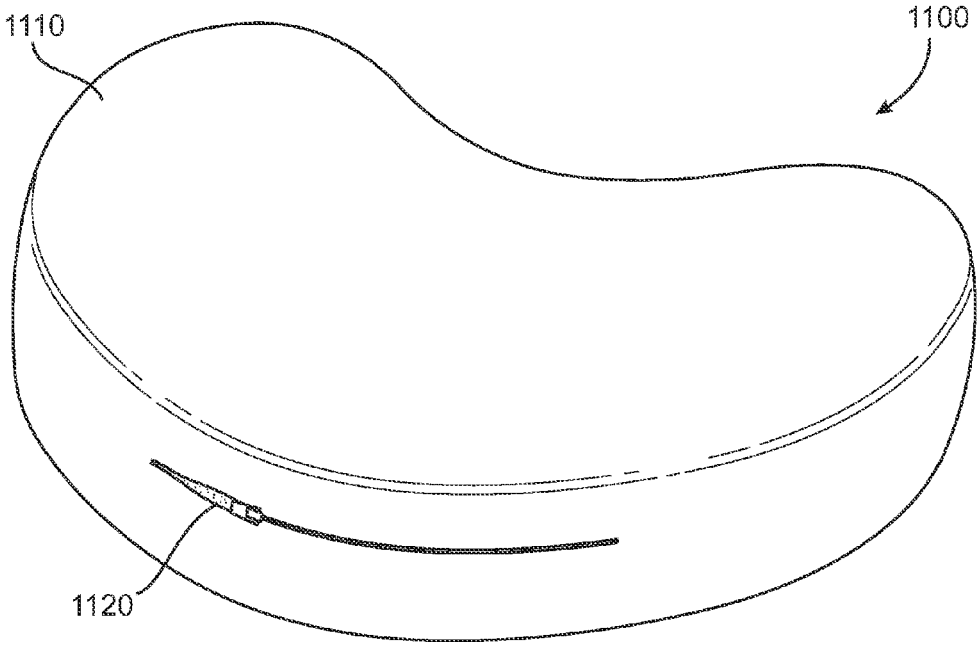
FIG. 11A shows a rear view of a cushion device including a cushion cover, according to an embodiment of the invention.
Figure 11B:
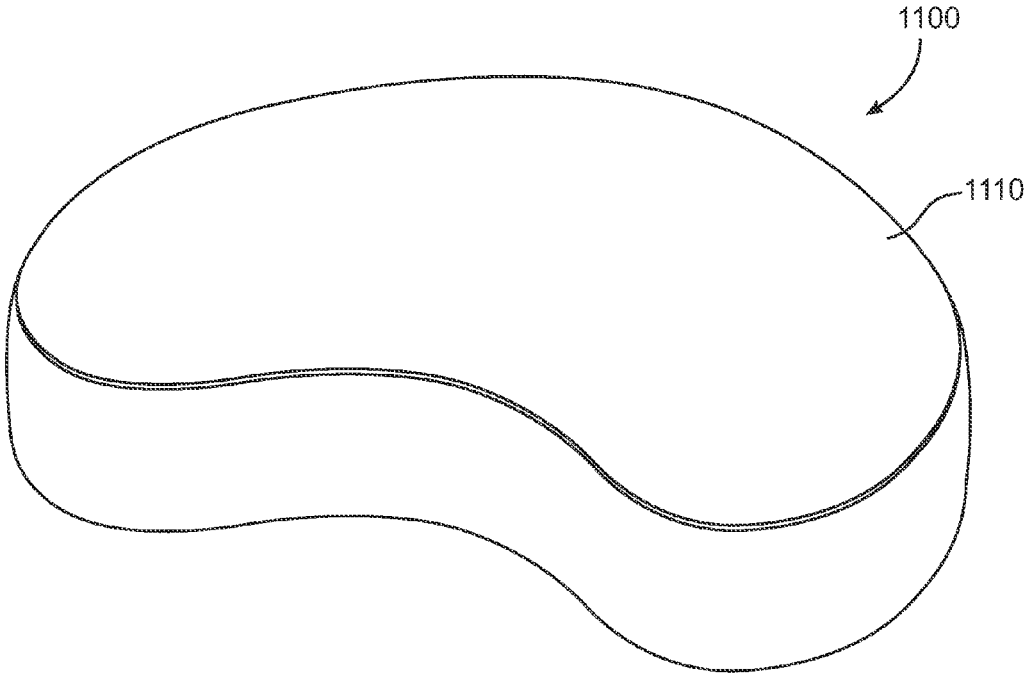
FIG. 11B shows a front view of the cushion device shown in FIG. 11A including a cushion cover, according to an embodiment of the invention.

FIG. 11A shows a rear view of an active support cushion device 100/300/1000 including a cushion cover 1110, according to an embodiment of the invention. In one example, the cushion cover 1110 includes a means for opening/closing 1120 the cushion cover 1110. The means for opening/closing 1120 the cushion cover 1110 may comprise a zipper, hook and loop fasteners, buttons, snaps, magnets, etc. The cushion cover 1110 may be made of any desirable material, such as silk, cotton, synthetic and natural blended fiber, wool, etc. The means for opening/closing 1120 the cushion cover 1110 allows for removal/insertion of an active support cushion device 100/300/1000 for replacement, cleaning of the cushion cover 1110, etc. FIG. 11B shows a front view of the active support cushion device 100/300/1000 including a cushion cover 1110 shown in FIG. 11A.

The above described embodiments including the active support cushion device 100/300/1000 use the first material layer 120 and viscoelastic members 130 and 135, and the second material layer 125 and viscoelastic members 130 and 135 properties in a lateral direction, which "suspends" a user's head (regardless of head weight) even while turning. The properties of the first material layer 120 and viscoelastic members 130 and 135, and the second material layer 125 and viscoelastic members 130 and 135 to create consistent comfort, without resistance into material of the first material layer 120 and viscoelastic members 130 and 135, and the second material layer 125 and viscoelastic members 130 and 135. The fill 310 adds a comfort layer (soft substrate), which supports a user's head allows ventilation through the fill material 310 and the material wall 110. The ventilation prevents heat build-up. The net effect is that the use of the active support cushion device 100/300/1000 feels as though a user's head is "floating" with support underneath allowing natural relaxation of the neck and head muscles. The active support cushion device 100/300/1000 may be used as for all sleeping positions with the same or similar result.

Figure 12:
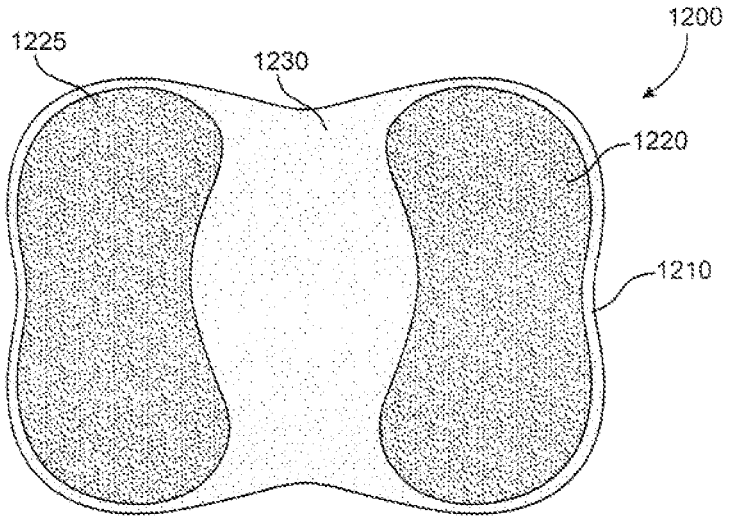
FIG. 12 shows a top view of an extended cushion device, according to an embodiment of the invention.

FIG. 12 shows a top view of an extended active support cushion device 1200, according to an embodiment of the invention. In one embodiment of the invention, the active support cushion device 1200 includes a first material layer 1210, viscoelastic members 1220 and 1225 and an extended center portion 1230 of the first material layer 1210. In one example, the active support cushion device 1200 includes upper and lower viscoelastic members 1220 and 1225 disposed on an upper layer and lower layer of the extended center portion 1230. In one example, the active support cushion device 1200 is similar as the embodiments shown in FIGS. 1-4 and described above. This embodiment of the support cushion device 1200 is similar in aspects as the cushion device 100 illustrated in FIG. 1 except for having a mirrored kidney bean shape so that the support cushion device 1200 can be used from either side and does not have to be turned around to position under a user's neck and shoulders properly. The support cushion device 1200 also provides an appearance similar to standard cushions having a rectangle shape as to fill a standard pillowcase. In one example, the support cushion device 1200 has a shape of two overlapping cushion devices 100 (FIG. 1) with kidney bean like shapes so both sides are equal in the shape. In one example, the support cushion device 1200 is more advantageous than the cushion device 100 for a person that desires to sleep on their stomach.

Figure 13:
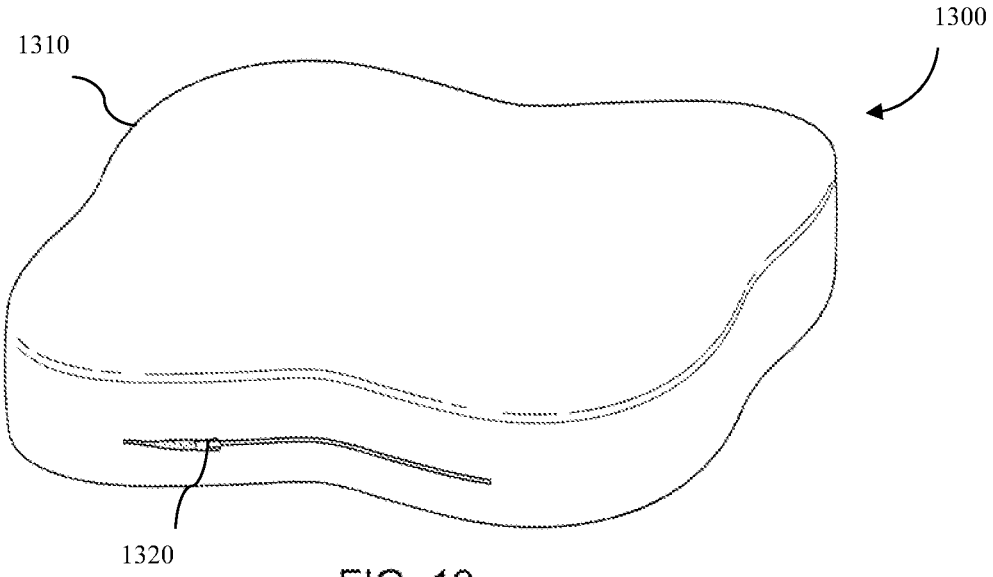
FIG. 13 shows a perspective view of including the extended cushion device of FIG. 12, according to an embodiment of the invention.

FIG. 13 shows a perspective view of an active support cushion device 1300 including a cushion cover 1310, according to an embodiment of the invention. In one example the cushion cover 1310 includes a means for opening/closing 1320 the cushion cover 1310. The means for opening/closing 1320 the cushion cover 1310 may comprise a zipper, hook and loop fasteners, buttons, snaps, magnets, etc. The cushion cover 1310 may be made of any desirable material, such as silk, cotton, synthetic and natural blended fiber, wool, etc. The means for opening/closing 1320 the cushion cover 1310 allows for removal/insertion of an active support cushion device 1200 for replacement, cleaning of the cushion cover 1310, etc.

Figure 14:
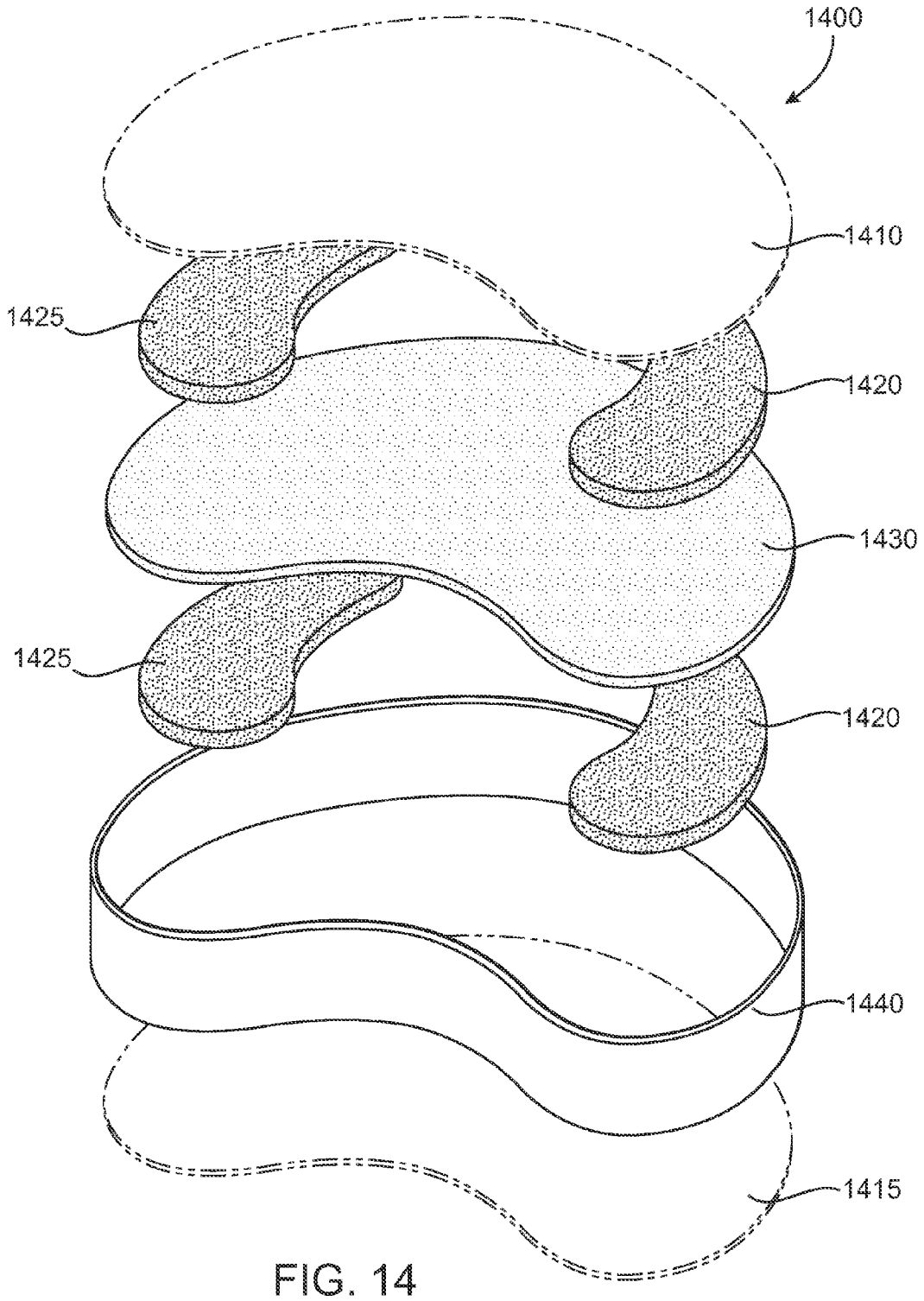
FIG. 14 shows an exploded view of another active support cushion, according to an embodiment of the invention.

FIG. 14 shows an exploded view of an active support cushion device 1400, according to one embodiment of the invention. In one example, the active support cushion device 140 includes a first material layer 1430 and a material wall 1440 that surrounds the first material layer 1430. In one example, the first material layer 1430 comprises a viscoelastic material, such as memory foam, polyurethane foam, or other similar material. In one embodiment of the invention, the first material layer 1430 includes viscoelastic members 1425 and 1420 that are coupled to a top and a bottom of the first material layer 1430, respectively. In one example, the viscoelastic material comprises memory foam or other similar material.

In one example, the first material layer 1430 has a curved shape. In another example, the viscoelastic members 1420 and 1425 may have a curved or tear-drop shape that mirrors one another.

In one embodiment of the invention, the viscoelastic members 1420 and 1425 are displaced a predetermined distance from edges of the material wall 1440. In one example, the viscoelastic members 1420 and 1425 are displaced a distance ranging from 10 mm to 20 mm from the edges of the material wall 1440. In one example, the viscoelastic members 1420 and 1425 a positioned a predetermined distance from the material wall 1440 ranging from 20 mm to 40 mm.

In one embodiment of the invention, the viscoelastic members 1420 and 1425 may have a thickness equal or greater than the thickness of the first material layer 1430. In one example, the thickness of the first material layer 1430 ranges from 8 mm to 15 mm, and the thickness of the viscoelastic members 1420 and 1425 range from 8 mm to 15 mm. The dimensions of each viscoelastic member 1420 and 1425 may range from a length of 30 cm to 40 cm, and a width of 12 cm to 16 cm. In one embodiment of the invention, viscoelastic members 1420 and 1425 are separated by a distance from one another ranging from 20 cm to 30 cm.

In one embodiment of the invention, the viscoelastic members 1420 and 1425 are a pair of viscoelastic members that are disposed on opposite ends of the active support cushion device 1400. It should be noted that while a pair of viscoelastic members 1420 and 1425 are shown, other examples may include more than two viscoelastic members 1420 and 1425. In one example, each viscoelastic member 1420 and 1425 may comprise multiple individual viscoelastic members.

In one embodiment of the invention, the viscoelastic members 1420 and 1425 are attached to the first material member 1430 via adhesive, heat welding, molding, etc. In one embodiment of the invention, the viscoelastic members 1420 and 1425 and the first material layer 1430 are formed as a single unit. In one example, the first material layer 1430 has a varying thickness that ranges from 8 mm to 20 mm.

In one embodiment of the invention, the material wall 1440 comprises synthetic fiber material made from a polymer containing polyurethane, such as Spandex®, cotton-lycra blends, polypropylene-Spandex® blends, or other similar materials. In other embodiments of the invention, the material wall is non-elastic. In one example, the material wall 1440 interacts with the first material layer 1430 including viscoelastic members 1420 and 1425 to actively support a user's anatomy (e.g., a head) when placed on the active support cushion device 1400.

In one embodiment of the invention, the active support cushion device 1400 may include a second material layer 1410 and a third material layer 1415. In one example, the second material layer 1410 may comprise desired material for an outer upper covering of the active support cushion device 1400, and the third material layer 1415 may comprise desired material for an outer lower cover of the active support cushion device 1400. In one example, the desired material may include cotton, silk, cheese cloth, synthetic materials, etc.

Figure 15:
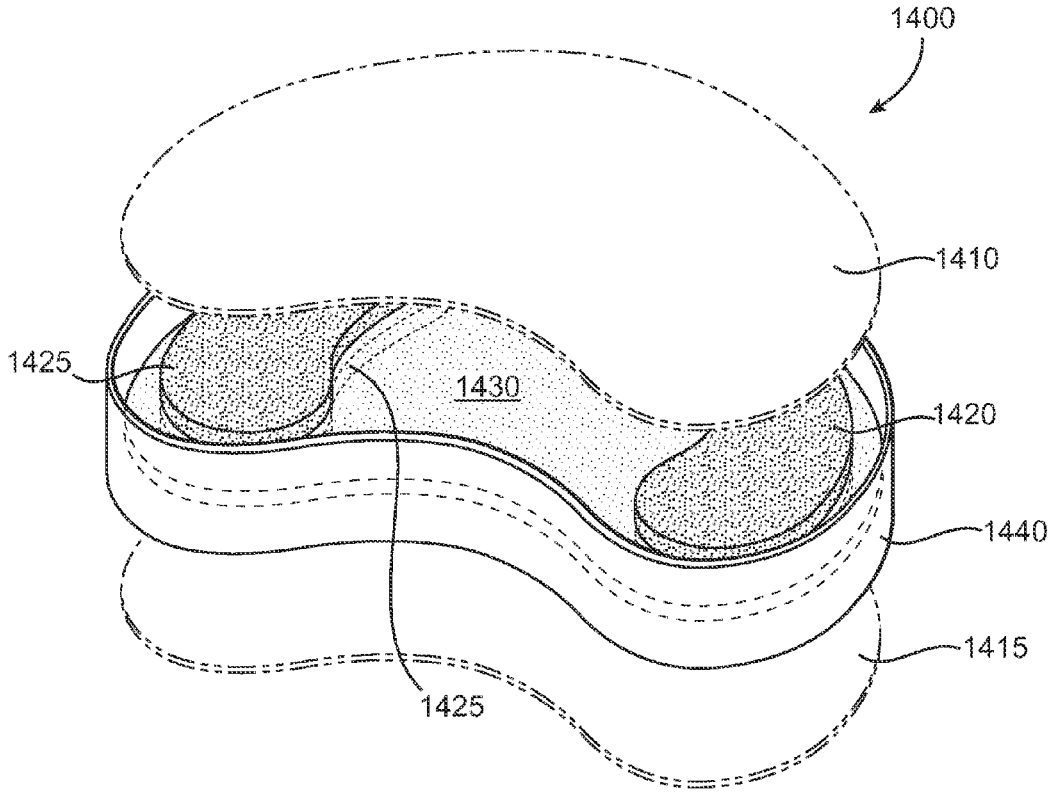
FIG. 15 shows a perspective view a cushion device centered in a material wall portion, according to an embodiment of the invention.

FIG. 15 shows a perspective view a cushion device 1400 including first material layer 1430 and viscoelastic members 1420 and 1425 centered between the material wall 1440, according to an embodiment of the invention. In one example, the first material layer coupled with the viscoelastic members 1420 and 1425 may be offset from the center of the material wall 1440. In one example, the arrangement of the first material layer 1430 and viscoelastic members 1420 and 1425 centered between the material wall 1440 control the timing aspect of flexing of the first material layer 1430 and viscoelastic members 1420 and 1425 and the retracting/pulling by the material wall 1440 in response to a force being applied to the cushion device 1400 from a person's anatomy (e.g., a person's head).

Figure 16:
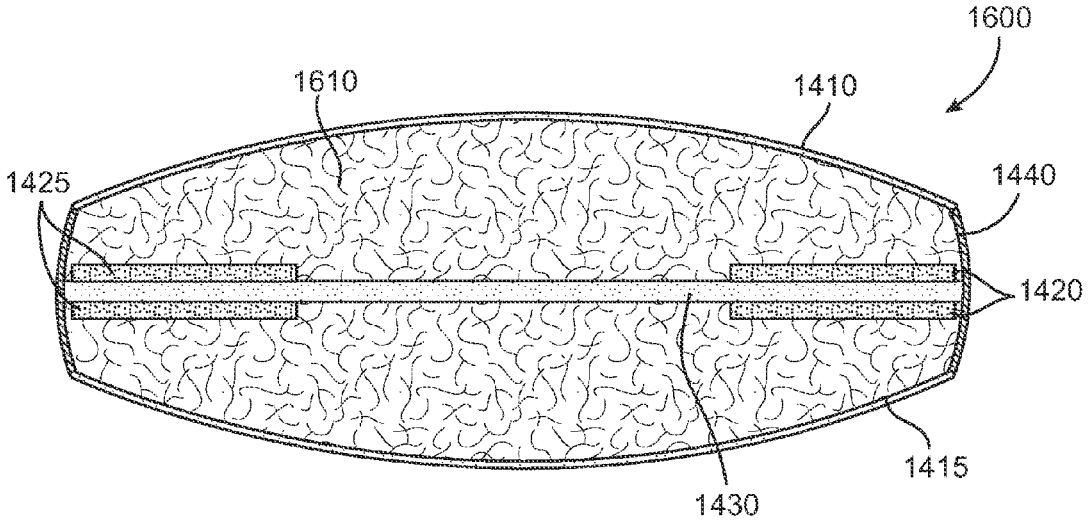
FIG. 16 shows a front cross sectional view of a cushion device, according to an embodiment of the invention.

FIG. 16 shows a front cross sectional view of the active support cushion device 1600, according to an embodiment of the invention. In one example, the active support cushion device 1600 includes a fill material 1610. In one example, the fill material 1610 may comprise feathers, synthetic feathers, cotton, wool, foam, latex, polyester, EVA foam, cellulose, organic materials, husks/hulls (e.g., buckwheat, bean sprout, millet, kapok, etc.), polyoleen, inorganic materials, etc. In one example, the fill material 1610 fills the volume above a top portion and below a bottom portion of the first material layer 1430 with viscoelastic members 1420 and 1425, and the elastic wall 1440. In one example, the protective covering or bag prevents a portion of the fill material 1610, such as feather quills or other feather portions, from protruding through the second material layer 1410 and the third material layer 1415.

The above described embodiments including cushion device 1400/1600 use the first material layer 1430 and viscoelastic members 1420 and 1425 properties in a lateral direction, which "suspends" a user's head (regardless of head weight) even while turning. The properties of the first material layer 1430 and viscoelastic members 1420 and 1425 create consistent comfort, without resistance into material of the first material layer 1430 and viscoelastic members 1420 and 1425. The fill 1610 adds a comfort layer (soft substrate), which supports a user's head allows ventilation through the fill material 1610 and the material wall 1440. The ventilation prevents heat build-up. The net effect is that the use of the cushion device 1400/1600 feels as though a user's head is "floating" with support underneath allowing natural relaxation of the neck and head muscles. The cushion device 1400/1600 may be used as for all sleeping positions with the same or similar result.

In other embodiments of the invention, similar cushion device to the active support cushion devices 100/300/1000 and the cushion devices 1400/1600 may be designed and configured for use in wheel chair cushions and portions of a mattress system.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment,"

"one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other modifications may occur to those ordinarily skilled in the art.

What is claimed is:

1. A cushion device comprising:

a first material layer coupled with at least a portion of a first plurality of viscoelastic members;

a second material layer coupled with at least a portion of a second plurality of viscoelastic members;

a material wall surrounding the first material layer and the second material layer, wherein:

at least a portion of the first material layer is circumferentially directly attached to the material wall, and at least a portion of the second material layer is circumferentially directly attached to the material wall, spaced from the first material layer, such that the material wall provides support for the first material layer and the second material layer; and a first fill material disposed in said space between the first material layer and the second material layer;

wherein:

the first material layer comprises a first opposing pair of laterally elongated viscoelastic members, and the second plurality of viscoelastic members comprise a second opposing pair of viscoelastic members;

the first opposing pair of laterally elongated viscoelastic members are displaced a predetermined distance from each other proximate ends of the first material layer, without other laterally elongated viscoelastic members therebetween on the first material layer;

the first opposing pair of laterally elongated viscoelastic members are placed a predetermined distance from edges of the material wall proximate ends of the first material layer.

2. The cushion device of claim 1, further comprising:

a third material layer coupled to a top portion of the first material layer; and a fourth material layer coupled to a bottom portion of the second material layer.

3. The cushion device of claim 1, wherein the material wall comprises elastic material, wherein the elastic material comprises synthetic fiber material made from a polymer containing polyurethane.

4. The cushion of claim 1, wherein each member of the first opposing pair of viscoelastic members and each member of the second opposing pair of viscoelastic members are displaced a predetermined distance from edges of the material wall.

5. The cushion device of claim 4, further comprising a second fill material disposed between the first material layer and the second material layer, wherein the second fill material adjusts firmness of the cushion device.

6. The cushion device of claim 1, wherein:

the first material layer is directly coupled with the first plurality of viscoelastic members;

the second material layer is directly coupled with the second plurality of viscoelastic members; and the first material layer and the second material layer each comprise laterally elongated viscoelastic material.

7. The cushion device of claim 6, wherein each member of the first opposing pair of viscoelastic members has a thickness equal to or greater than the first material layer, and each member of the second opposing pair of viscoelastic members has a thickness equal to or greater than the second material layer.

8. The cushion device of claim 1, wherein:

the first opposing pair of viscoelastic members are positioned proximate the periphery of the first material layer proximate edges of the material wall, spaced from one another and devoid of other laterally elongated viscoelastic members between the first opposing pair of viscoelastic members on the first material layer; and in response to a weight placed on the first material layer, the first plurality of viscoelastic members control stretching of the first material layer under the weight, while the material wall provides resistance to stretching of the first material layer due to attachment of the first material layer to the material wall.

9. The cushion device of claim 8, wherein:

the cushion device provides resistance to a force applied on the cushion device; and the material wall and the viscoelastic members control the resistance of the cushion device to a force applied on the cushion device.

10. The cushion device of claim 9, wherein:

each material layer comprises a bi-directional memory retentive viscoelastic foam; and each viscoelastic member is directly coupled to each material layer and controls the rate of stretching of said material layer when a force is applied on the cushion device.

11. The cushion device of claim 9, wherein:

the material wall comprises bi-directional fabrics; and the material wall provides resistance to stretching of each attached material layer when a force is applied on the cushion device.

12. The cushion of claim 9, wherein:

the material wall elastically retracts the first material layer when an applied force is removed from the cushion; and viscoelastic members control the rate of rebound of the cushion device when the applied force is removed from the cushion.

13. The cushion device of claim 1, wherein:

each viscoelastic member of the first plurality of the viscoelastic members is coupled to the first material layer separate and spaced apart from other viscoelastic members of the first plurality of the viscoelastic members coupled to said first material layer; and each viscoelastic member of the second plurality of the viscoelastic members coupled to the second material layer is separate and spaced apart from other viscoelastic members of the second plurality of the viscoelastic members coupled to said second material layer.

14. A cushion device comprising:

a first material layer having varying thickness, wherein the first material layer comprises at least one viscoelastic material;

a second material layer;

a material wall surrounding the first material layer and the second material layer, wherein at least a portion of the first material layer is circumferentially directly attached to the material wall, and at least a portion of the second material layer is circumferentially directly attached to the material wall, spaced from the first material layer, such that the material wall provides support for the first material layer and the second material layer; and a first fill material disposed in a space between the first material layer and the second material layer, wherein:

the first material layer comprises a first opposing pair of laterally elongated viscoelastic members;

the first opposing pair of laterally elongated viscoelastic members are displaced a predetermined distance from each other, without other laterally elongated viscoelastic members therebetween, on the first material layer;

the first opposing pair of laterally elongated viscoelastic members are placed on the first material layer a predetermined distance from edges of the material wall, the first opposing pair of laterally elongated viscoelastic members are positioned proximate edges of the material wall on the first material layer devoid of other laterally elongated viscoelastic members between the first opposing pair of viscoelastic members on the first material laver.

15. The cushion device of claim 14, wherein the second material layer comprises at least one viscoelastic material.

16. The cushion device of claim 14, further comprising:

a third material layer coupled to a top portion of the first material layer.

17. The cushion device of claim 16, further comprising:

a fourth material layer coupled to a bottom portion of the second material layer.

18. The cushion device of claim 14, wherein the material wall comprises an elastic material, wherein the elastic material comprises synthetic fiber material made from a polymer containing polyurethane.

19. The cushion device of claim 14, wherein:

each member of the first opposing pair of viscoelastic members are displaced a predetermined distance from edges of the material wall, separate and spaced from one another;

and in response to a weight placed on the first material layer, the viscoelastic members by viscoelastic behavior control stretching of the first material layer under the weight, while the material wall by elastic behavior provides resistance to stretching of the first material layer due to attachment of the first material layer to the material wall.

20. The cushion device of claim 19, further comprising a second fill material disposed between the first material layer and the second material layer, wherein the second fill material adjusts firmness of the cushion device.

21. A support pillow comprising:

a first viscoelastic material layer coupled with an opposing first pair of viscoelastic members;

a second viscoelastic material layer coupled with an opposing second pair of viscoelastic members;

a material wall surrounding the first material layer and the second material layer, the material wall comprising synthetic fiber material made from a polymer containing polyurethane, wherein at least a portion of the first viscoelastic material layer is directly circumferentially attached to the material wall, and at least a portion of the second viscoelastic material layer is circumferentially directly attached to the material wall, spaced from the first viscoelastic material layer, such that the material wall provides support for the first viscoelastic material layer and the second viscoelastic material layer; and a first fill material disposed in a space between the first viscoelastic material layer and the second viscoelastic material layer;

wherein:

the first material layer comprises a first opposing pair of laterally elongated viscoelastic members;

the first opposing pair of laterally elongated viscoelastic members are displaced a predetermined distance from each other, without other laterally elongated viscoelastic members therebetween, on the first material layer;

the first opposing pair of laterally elongated viscoelastic members are positioned proximate opposite ends of the first material layer.

22. The support pillow of claim 21, further comprising:

a third material layer coupled to a top portion of the first material layer; and a fourth material layer coupled to a bottom portion of the second material layer.

23. The support pillow of claim 21, wherein:

each member of the first opposing pair of viscoelastic members and each member of the second opposing pair of laterally elongated viscoelastic members are displaced a predetermined distance from edges of the material wall, separate and spaced from one another, the first opposing pair of laterally elongated viscoelastic members are positioned proximate edges of the material wall on the first material layer devoid of other laterally elongated viscoelastic members between the first opposing pair of viscoelastic members on the first material layer; and in response to a weight placed on the first material layer, the viscoelastic members by viscoelastic behavior control the rate of stretching of the material layers under the weight, while the material wall by elastic behavior provides resistance to stretching of the material layers due to attachment of the material layers to the material wall.

24. The support pillow of claim 23, further comprising a second fill material disposed between the first material layer and the second material layer, wherein the second fill material adjusts firmness of the cushion device.

25. A cushion comprising:

a first material layer coupled with a first plurality of viscoelastic members and a second plurality of viscoelastic members, wherein the first of viscoelastic members are coupled to a first side of the first material layer, and the second plurality of viscoelastic members are coupled to a second side of the first material layer, opposing said first side;

a material wall surrounding the first material layer, wherein at least a portion of the first material layer interacts with the material wall to support for the first material layer; and a first fill material coupled to the first side of the first material layer and the second side of the first material layer;

wherein:

the first plurality of viscoelastic members comprise a first opposing pair of laterally elongated viscoelastic members, and the second plurality of viscoelastic members comprise a second opposing pair of viscoelastic members;

each viscoelastic member coupled to the first material layer by viscoelastic behavior controls the flexing of the first material layer when a force is applied on the cushion device, and the material wall provides support to the first material layer by elastic behavior due to attachment to the first material layer, wherein:

the first opposing pair of laterally elongated viscoelastic members are displaced a predetermined distance from each other, without other laterally elongated viscoelastic members therebetween, on the first material layer;

the first opposing pair of laterally elongated viscoelastic members are placed on the first material layer proximate the material wall.

26. The cushion of claim 25, further comprising:

a second material layer directly coupled to a top portion of the material wall, such that the material wall provides support for the second material layer; and a third material layer directly coupled to a bottom portion of the material wall, such that the material wall provides support for the third material layer;

wherein the first material layer is spaced between the second material layer and the third material layer.

27. The cushion of claim 25, wherein the material wall comprises elastic material, wherein the elastic material comprises synthetic fiber material made from a polymer containing polyurethane.

28. The cushion of claim 25, wherein each member of the first opposing pair of viscoelastic members and each member of the second opposing pair of viscoelastic members are displaced a predetermined distance from edges of the material wall.

29. The cushion of claim 28, further comprising a suspension material dispersed with the fill material.

30. The cushion of claim 25, wherein the first material layer comprises viscoelastic material.

31. The cushion of claim 30, wherein each member of the first opposing pair of viscoelastic members has a thickness equal to or greater than the first material layer, and each member of the second opposing pair of viscoelastic members has a thickness equal to or greater than the first material layer.

32. The cushion of claim 25, wherein:

each viscoelastic member of the first plurality of the viscoelastic members is coupled to the first material layer separate and spaced apart from other viscoelastic members coupled to the first material layer.

* * * * *